United States Patent [19]

Lindstrom et al.

[11] Patent Number: 4,519,322

[45] Date of Patent: May 28, 1985

[54] LOW PRESSURE LOSS BURNER FOR COAL-WATER SLURRY OR FUEL OIL

[75] Inventors: Gerald D. Lindstrom, N. Benton; Clifford F. Eckhart, Alliance; George A. Farthing, Jr., Homeworth; James J. Muckley, Louisville; Brian E. Taylor, Akron, all of Ohio

[73] Assignee: The Babcock & Wilcox Company, New Orleans, La.

[21] Appl. No.: 622,900

[22] Filed: Jun. 21, 1984

[51] Int. Cl.[3] ..... F23D 1/02

[52] U.S. Cl. ..... 110/264; 110/347; 431/184; 431/188

[58] Field of Search ..... 110/263, 264, 347; 431/183, 184, 188

[56] References Cited

U.S. PATENT DOCUMENTS

| | | | |
|---|---|---|---|
| 3,124,086 | 3/1964 | Sage et al. | 110/264 |
| 3,145,670 | 8/1964 | Copian et al. | 431/184 |
| 3,904,349 | 9/1975 | Peterson et al. | 431/184 |
| 4,333,405 | 6/1982 | Michelfelder et al. | 431/184 |

*Primary Examiner*—Edward G. Favors

*Attorney, Agent, or Firm*—Robert J. Edwards

[57] ABSTRACT

An apparatus for burning fuel oil or a fuel composed of a concentrated coal-water slurry has a circular air register with circumferentially overlapping vanes mounted concentrically to fuel supply means and larger diameter cylinders arranged to define a triple annuli therebetween adjacent to a frusto-conical burner port.

4 Claims, 2 Drawing Figures

LOW PRESSURE LOSS BURNER FOR COAL-WATER SLURRY OR FUEL OIL

BACKGROUND OF THE INVENTION

1. Field of the Invention

This invention relates to fuel burning apparatus and more particularly to a burner for firing a concentrated coal-water slurry, or fuel oil, in a utility or industrial boiler.

The drive for energy independence and, more particularly, the drive away from dependence upon foreign oil fuel sources, has led to the reevaluation of coal as an economical, near term oil-fuel substitute suitable for use in utility or industrial boilers designed to burn oil. Although fuel development research has been heavily focused upon coal-oil mixtures, coal-water slurries are economically more attractive fuels. Coal-water slurries, for example, are reportedly twenty to fifty percent cheaper than No. 6 fuel oil while, in comparison, the cost differential between coal-oil mixtures and No. 6 fuel oil is approximately five percent (Chemical Engineering, June 27, 1983, p.16).

Concentrated coal-water slurries are composed of a concentrated suspension, sixty-five to eighty percent by weight on a moisture-free basis, of pulverized coal or other carbonaceous fuels, in water containing a small percentage of chemical additives to stabilize the suspension. Such concentrated slurries differ from coal-water slurries containing smaller percentages of coal in that the concentrated slurries can be burned directly, i.e., without dewatering. The advantages of coal-water slurries as a boiler fuel include ease of handling, tranporting and storing a liquid-like fuel, low cost per unit of energy, independence of foreign oil, the capacity for integration with coal-water slurry pipeline systems, and technical and economic feasibility of retrofitting oil-designed boilers to burn coal-water slurries. In fact, the principal market for coal-water slurries, in the near-term, will be as a fuel for existing boilers originally designed to burn oil. The retrofitting of oil-fired boilers to use concentrated coal-water slurries necessitates the development of burners which can reliably and efficiently fire a slurry of pulverized coal and water or fuel oil.

Since a coal-water slurry behaves like a liquid fuel, it can be burned like fuel oil. Thus, the coal-water slurry is atomized and mixed with combustion air to form a stable flame front at or near the burner. It is most desirable to induce a high swirl at the burner as a means to stabilize the flame. The high swirl creates a strong recirculation of hot combustion products back into the ignition zone where drying and ignition of the coal particles contained in the incoming coal-water slurry droplets take place.

2. Description of the Prior Art

Previous suggestions have been made, for example, see U.S. Pat. No. 3,124,086, for burning a coal-water slurry which is not highly concentrated. As disclosed in U.S. Pat. No. 3,124,086, combustion air must be supplied at relatively high pressure which results in undesirable high pressure losses across the burner. In addition, the combustion air must generally be heated to a relatively high temperature.

SUMMARY OF THE INVENTION

Circular register burners are frequently used for oil firing in utility and industrial type boilers. The circular register burners include tangentially disposed doors built into the periphery of a cylindrical casing to provide the turbulence necessary to mix the fuel and air and produce short, compact flames. The burner is designed so that the direction and velocity of the air, plus dispersion of the fuel, are controlled to thoroughly and completely mix the fuel with the combustion air.

Coal-water slurry combustion tests performed with a circular air register burner led to the discovery that auxiliary natural gas firing was required to achieve and maintain flame stability until the air register doors were essentially pinched closed to create the necessary turbulence and air swirl needed to fire without a support fuel.

Accordingly, a circumferentially overlapped register door configuration was aerodynamically designed and developed to achieve the high swirl and recirculation needed for maintaining coal-water slurry flame stability at low windbox-to-furnace pressure drops.

Thus, in accordance with the invention, an apparatus is provided for burning fuel oil or a concentrated coal-water slurry fuel composed of at least sixty-five percent weight of pulverized coal in combination with a frusto-conical burner port which tapers outwardly through a wall separating the windbox and furnace chamber of a boiler. The apparatus includes an atomizer concentrically arranged within the burner port. The atomizer is connected to a burner barrel disposed within a concentric cylindrical casing that is mounted to the wall. A cylindrical sleeve surrounds fuel supply means including the barrel to define an inner annulus therebetween. A sliding register is mounted to the sleeve and is slidably adjustable to pass air through openings in the sleeve from the windbox to the inner annulus. A cylindrical housing is concentrically arranged about the sleeve intermediate and radially spaced from the sleeve and the casing to respectively define intermediate and outer annuli therebetween. The sleeve and housing have radially aligned open ends proximate to and axially spaced from the burner port. The casing has a series of openings at circumferentially-spaced intervals in its periphery that are radially aligned with the housing. A plurality of substantially identical curvilinear vanes are mounted in the openings. The vanes have offset ends that circumferentially overlap the curvilinear opposite ends of adjacent vanes. Combustion air, tangentially passing through the radial spacing between the overlapped end and the curvilinear end portion of adjacent vanes, swirls into the outer annulus and the burner port.

The various features of novelty which characterize the invention are pointed out with particularity in the claims annexed to and forming a part of this specification. For a better understanding of the invention, its operating advantages and the specific objects attained by its use, reference should be had to the accompanying drawings and descriptive matter in which there is illustrated and described a preferred embodiment of the invention.

DETAILED DESCRIPTION

The same numerals refer to like or similr parts in both views.

Figure 1:
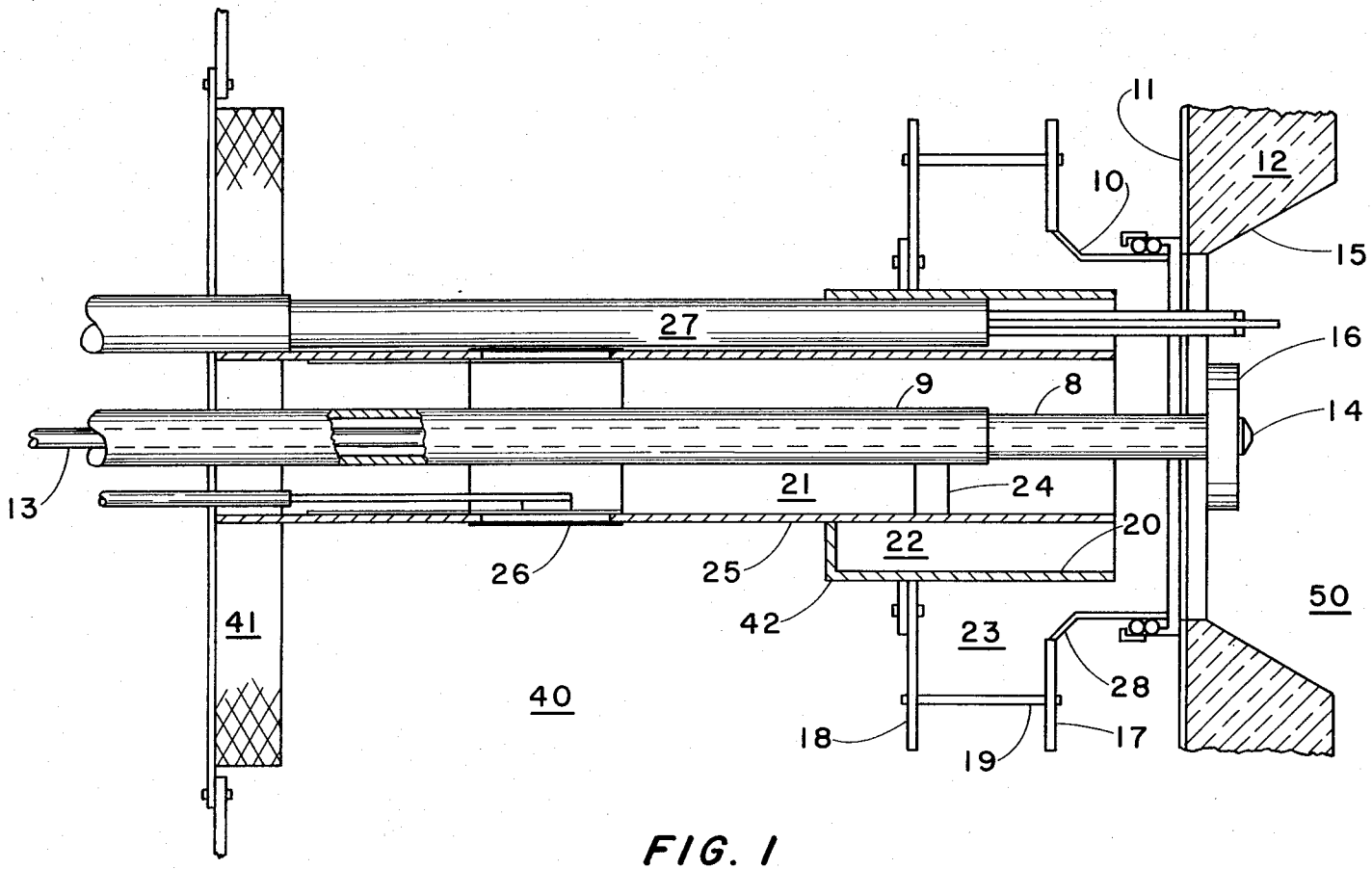
FIG. 1 is a vertical section through the burner wall of a boiler showing the improved burner arrangement.

As shown in FIG. 1, a cylindrical casing 10, which comprises a burner support and air register, described hereafter, is mounted to wall means composed of an outer shell plate 11 which backs a refractory wall 12, separating a windbox 40 and furnace chamber 50 of a boiler adapted to burn a concentrated coal-water slurry fuel as well as fuel oil.

The coal-water slurry passes, via a burner barrel 13, through a nozzle comprising an atomizer 14 mounted at an end of the barrel 13 and is discharged into a frusto-conical burner port or throat 15 formed in the wall 12 of the boiler. The opposite end of the barrel 13 extends through a distance piece 8 which is in turn supported within a cylindrical sleeve 9, the latter being supported by an outer wall 41 of the windbox 40. A swirler 16 is coaxially mounted to the distance piece 8 directly upstream of the atomizer 14. The distance piece 8 is slidably received for axial movement within the cylindrical sleeve 9. The barrel 13 extends coaxially through the sleeve 9 and distance piece 8.

The barrel 13 is illustrated, in part, by dotted lines within the distance piece 8. The barrel 13, the distance piece 8 and the cylindrical sleeve 9 are not critical to the inventive apparatus. Accordingly, the barrel 13, the distance piece 8 and the cylindrical sleeve 9 are collectively referred to as the fuel supply means.

Figure 2:
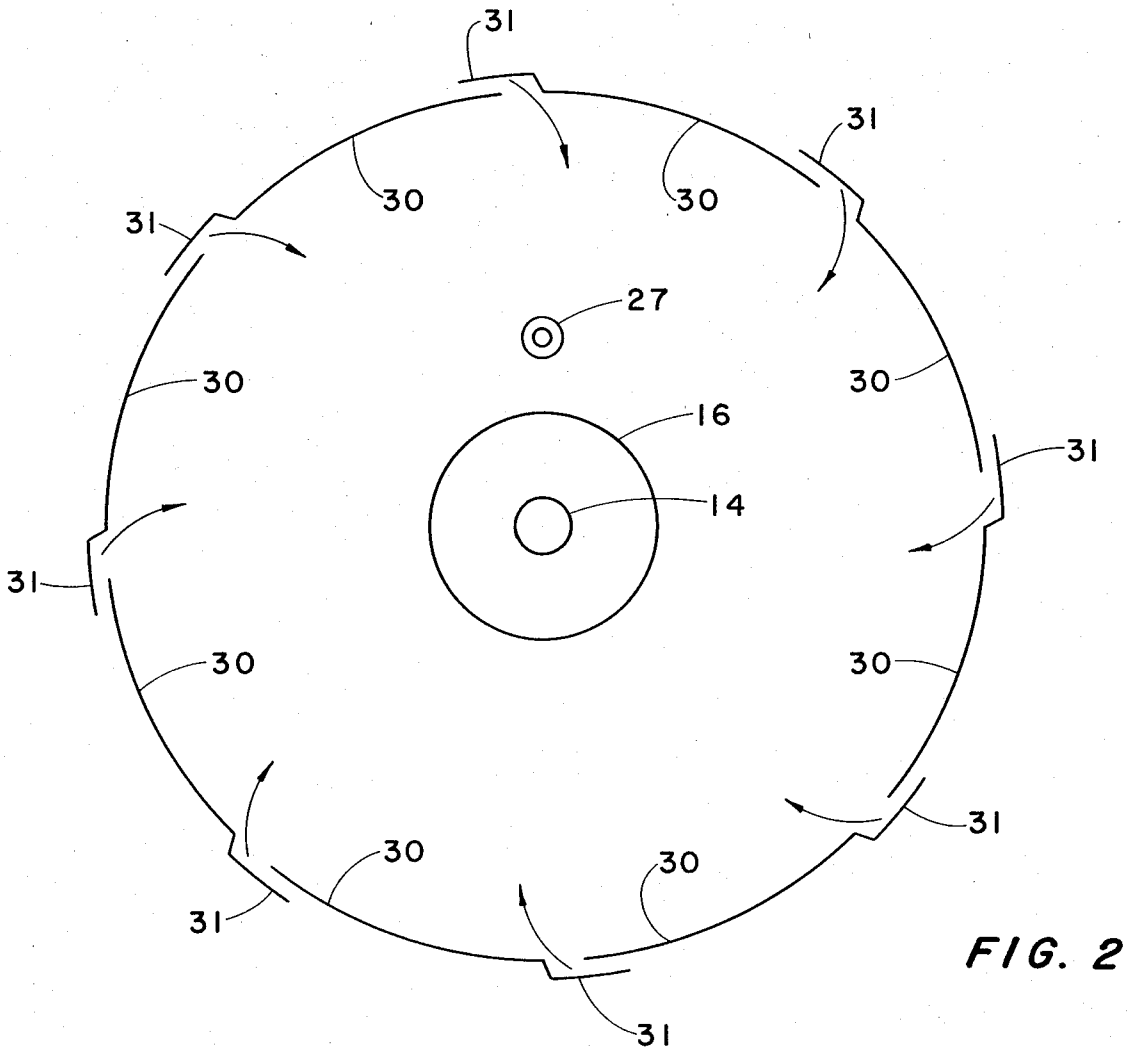
FIG. 2 is a schematic representation of the configuration of the curvilinear vanes with overlapping ends constructed in accordance with the invention.

The cylindrical casing 10 is mounted concentric with and radially spaced from the barrel 13. The cylindrical casing 10, has one end mounted to the outer shell plate 11, coaxially of the burner port 15, and is situated in the windbox 40. The casing 10 includes a pair of radially extending flanges 17 and 18 which support pivot pins 19 to which the curvilinear vanes 30, schematically shown in FIG. 2, are mounted. The flange 17 is connected to a cylindrical foreportion of the casing 10 via a 45-degree transition member 28 to minimize pressure losses. A cylindrical housing 20 is fixed to the inner radial end of the flange 18. The cylindrical housing 20 is concentrically mounted about a sleeve 25 and radially spaced intermediate the sleeve 25 and casing 10. The housing 20 has a first end open proximate to and axially spaced from the burner port 15 and a second end remote from the burner port 15. The second end is closed by a radial plate 42.

The sleeve 25 is fitted within the housing 20 concentrically surrounding the fuel supply means to define an inner annulus 21 therebetween and to form an intermediate annulus 22 between the sleeve 25 and the housing 20. An outer annulus 23 is located between the flanges 17 and 18, the sleeve 25 and the register doors, i.e., vanes 30, schematically shown in FIG. 2. A conventional spider 24 supports the distance piece 13 within the sleeve 25.

A sliding register assembly 26 is mounted to the sleeve 25 and is operable to provide air flow from windbox 40 to the inner annulus 21. The sliding register assembly is a conventional unit of a type well-known in the art. An igniter 27 extends through the radial plate 42 and the intermediate annulus 22 into the burner throat 15. The igniter 27 is a conventional oil or gas igniter which is normally utilized during boiler startup.

As schematically shown in FIG. 2 the circular register assembly is comprised of a plurality of arcuate curvilinear register doors or vanes 30, designed to be pivoted on the pivot pins 19, shown in FIG. 1. The vanes 30 are radially stepped to form an offset end 31 which circumferentially overlaps the opposite end of an identical vane 30 and is radially spaced therefrom so as to form a flow path therebetween as shown by the directional arrows. The offset, overlapping end portion 31 is radially spaced from an opposite, curvilinear end of the adjacent vane 30 which is not offset. The end of the adjacent vane is circumferentially aligned and spaced from the body portion of the vane prior to the point where it is stepped, i.e., both lie on a common circumference.

In operation, the burner channels the flow of combustion air from a windbox 40 into the furnace chamber 50 to achieve the necessary flow patterns. The outer annulus 23 is supplied with a tangential flow of air through the spacing between the curved, overlapping doors 30. Although the overlapping vane arrangement is the primary unique aspect of the design, it alone would not achieve the desired flow pattern. The circulr register assembly is aerodynamically designed to provide the desirable high-swirl pattern with low viscous energy dissipation, i.e., low burner pressure loss.

The intermediate annulus 22 provides a relatively inactive air zone wherein an oil, gas or other ignition source can be located. This placement is functionally desirable since the use of a relatively inactive zone does not disturb the flow patterns achieved by the other zones. The intermediate annulus is provided with openings in the radial wall 42 to circulate sufficient air through the intermediate annulus 22 to prevent coal ash particle deposition.

The inner annulus 21 is supplied with air from the sliding register assembly 26. The burner 13 can be alternately used to supply coal-water slurry or fuel oil. The bladed swirler 16 creates a small recirculation zone and stabilizes the vortex flow in the furnace.

The burner throat 15 of the burner is similar to that of standard type burners. Its shape is that of a truncated cone which expands towards the combustion furnace.

The atomizer 14 utilized for preliminary coal-water slurry combustion testing was a modified Babcock & Wilcox T-jet atomizer having the exit angle and number of jets needed to provide a spray compatible with the burner air patterns. An air or steam atomized spray interaction provides a swirling, toroidal-type flow pattern.

Calculations for coal-water slurry burner dimensions for an operating condition of 40 million Btu/hr, utilizing a 24-inch diameter throat, demonstrate that construction of the burner system with the following approximate parameters will yield an advantageously low windbox-to-furnace pressure drop. In particular, the following approximate ratio of the axial velocity in the outer annulus 23, intermediate annulus 22 and inner annulus 21 to the total axial velocity in the throat have been found to be important parameters: 1.72, 0.24, and 0.47, respectively. A ratio of the tangential velocity to the axial velocity in the outer annulus 23 of approximately 1.26 has been calculated to be significant where the resultant velocity vector angle is approximately 52-degrees. The ratio of the length of overlap of the vanes to the radial distance between the tip of the inner vane and body of the outer blade is critical insofar as the ratio must be greater than 1.0; for the calculations, discussed above, a ratio of 1.135 was determined to be sufficient.

Testing of a prototype burner, according to the inventive design, has shown that a stable coal-water slurry fueled flame is maintained, i.e., has a stationary flame front in the burner throat. Low pressure loss is achieved, under comparable operating conditions, relative to existing burner designs previously tested to determine suitability for burning concentrated coal-water slurries. This burner, which has a relatively simple design, can also be used to burn fuel oil passed through the barrel. The inventive burner arrangement has a 2½ to 1 turndown ratio with a coal-water slurry fuel, i.e., the burner fuel rate can be varied over a 2½ to 1 range without changing the number of burners in operation and with complete combustion. The inventive burner arrangement can combust a coal-water slurry with a combustion air temperature as low as 180-degrees Fahrenheit. The igniter is positioned far enough away from the barrel so as not to obstruct the main combustion air stream and to permit steam or air purging of the fuel from the barrel without extinguishing the igniter.

The foregoing description has been directed to a particularly preferred embodiment of the present invention for purposes of explanation and illustration. It should be recognized, however, by those skilled in the art that modifications and changes in the invention may be made without departing from the scope and spirit of the invention. It is therefore intended that the following claims cover all equivalent modifications and variations as fall within the scope of the invention as defined by the claims.

The embodiments of the invention in which an exclusive property or privilege is claimed are defined as follows:

1. In a boiler having wall means separating a windbox from a furnace chamber, the wall means having a frustoconical burner port outwardly tapering therethrough from the windbox to the furnace chamber, an apparatus for burning a concentrated coal-water slurry fuel, composed of at least sixty-five weight percent of pulverized coal, comprising a coal-water fuel atomizer concentric within the burner port and fuel supply means including a burner barrel within the windbox connected with the atomizer, an outer cylindrical casing concentric with and radially spaced from the fuel supply means and having one end mounted to the wall means on the windbox side, a cylindrical sleeve surrounding and radially spaced from the fuel supply means to define an inner annulus therebetween, said sleeve having an end opening within the casing proximate to and axially spaced from the burner port, said sleeve including means for passing air therethrough to the inner annulus from the window, a cylindrical housing concentrically mounted about at least part of the sleeve intermediate and radially spaced from the sleeve and the casing to define an outer annulus between the housing and the casing, said cylindrical housing having a first end open proximate to and axially spaced from the burner port, a second end axially spaced remote from the burner port and a plate closing the second end, said casing having a series of openings at circumferentially-spaced intervals in its periphery radially aligned with the housing adapted to supply air from the windbox to the outer annulus, a plurality of cuvilinear vanes, each of said vanes movably mounted in a respective one of the openings to regulate air passage therethrough, each of said vanes having an offset end circumferentially overlapping and radially spaced from an opposite end of an adjacent one of said vanes.

2. The combination as set forth in claim 1 wherein the offset end is curvilinear and extends in spaced parallel relationship relative to the end of the adjacent vane.

3. The combination as set forth in claim 2 wherein the said end of the adjacent vane has an edge circumferentially aligned and spaced from a portion of the adjacent curvilinear vane.

4. The combination as set forth in clim 3 herein said means for passing air through the sleeve comprises a sliding register.

* * * * *